United States Patent [19]

Lankheet

[11] 3,975,782

[45] Aug. 24, 1976

[54] POOL SIDEWALL TO FLOOR CONNECTION

[76] Inventor: Jay A. Lankheet, 579 Ottawa Ave., Holland, Mich. 49423

[22] Filed: Aug. 26, 1974

[21] Appl. No.: 500,614

[52] U.S. Cl. ..... 4/172; 4/172.19

[51] Int. Cl.[2] ..... E04H 3/16

[58] Field of Search ..... 4/172, 172.19, 172.21; 52/169

[56] References Cited

UNITED STATES PATENTS

| | | | |
|---|---|---|---|
| 3,177,501 | 4/1965 | Kwake | 4/172 R |
| 3,354,473 | 11/1967 | Schwarz et al. | 4/172 R |
| 3,585,655 | 6/1971 | Lankheet | 4/172 R |
| 3,588,924 | 6/1971 | Goettl | 4/172.19 |
| 3,739,539 | 6/1973 | Posaick | 4/172.19 X |
| 3,750,197 | 8/1973 | Weir et al. | 4/172.19 |

*Primary Examiner*—Richard E. Aegerter
*Assistant Examiner*—Charles E. Phillips
*Attorney, Agent, or Firm*—Woodhams, Blanchard and Flynn

[57] ABSTRACT

A swimming pool construction employing a plurality of prefabricated wall panels for forming the sidewall of the pool, and a flexible liner attached to the sidewall and positioned over a floor of soil, such as sand. The liner attaches to the sidewall adjacent the lower end thereof so as to be totally disposed below the water level. The sidewall has a horizontal channel-like retaining member fixed adjacent the lower edge thereof, which retaining member opens outwardly for communication with the pool. The sidewall also has a narrow horizontally extending groove formed therein closely adjacent but spaced upwardly from the retaining member. The liner has a bead secured adjacent the free edge thereof, which bead is retained within the retaining member to maintain the liner in proper position when the pool is filled with water. The liner has a sheetlike flap which projects upwardly above the bead and has the edge thereof positioned within the groove. A sealant is inserted into the groove for creating a watertight seal between the flap and the sidewall.

1 Claim, 3 Drawing Figures

POOL SIDEWALL TO FLOOR CONNECTION

FIELD OF THE INVENTION

This invention relates generally to swimming pools and, in particular, to a swimming pool of the type utilizing a flexible liner therein.

BACKGROUND OF THE INVENTION

Many swimming pools employ a flexible liner for retaining the water. The pool can be manufactured in an efficient and economical manner by using only a sidewall to which the liner is attached, with the floor of the pool being defined by soil or sand over which the liner is extended. In this known pool structure, the liner is normally sized to extend not only across the floor of the pool, but also vertically along the sidewall of the pool throughout substantially the full height thereof, with the liner being attached to the pool sidewall by a beadlike clamping structure. This clamping structure is normally disposed above the waterline of the pool in order to prevent leakage.

While the above-described structure is successful from the standpoint of initially providing a leakproof pool, nevertheless pools of this type have been observed to experience substantial liner damage. Particularly, since the liner completely overlaps the sidewall of the pool, the liner often becomes ripped or cut due to contact thereof by the feet of swimmers, particularly when the swimmers climb out of the pool without using the provided steps or ladders. When such damage occurs, repair of the liner is often impossible, and replacement of the liner is both time consuming and costly.

Accordingly, it is an object of the present invention to provide an improved swimming pool structure of the type utilizing a liner therein, which structure overcomes the above-discussed disadvantages. The desirable pool structure of the present invention utilizes a liner which is both mechanically and sealingly connected to the pool sidewall adjacent the lower end thereof, whereby the liner is totally immersed beneath the water level and leaves the primary area of the sidewall uncovered. The pool structure thus utilizes a liner which eliminates those areas which were susceptible to maximum abuse and damage in the prior pool structures.

It is also an object of the present invention to provide a swimming pool structure, as aforesaid, which permits the utilization of a substantially smaller liner while permitting the efficient and economical construction of the swimming pool, while additionally retaining a desirable sealed relationship to prevent leakage.

Other objects and purposes of the present invention will be apparent to persons acquainted with structures of this general type upon reading the following specification and inspecting the accompanying drawings.

Figure 1:
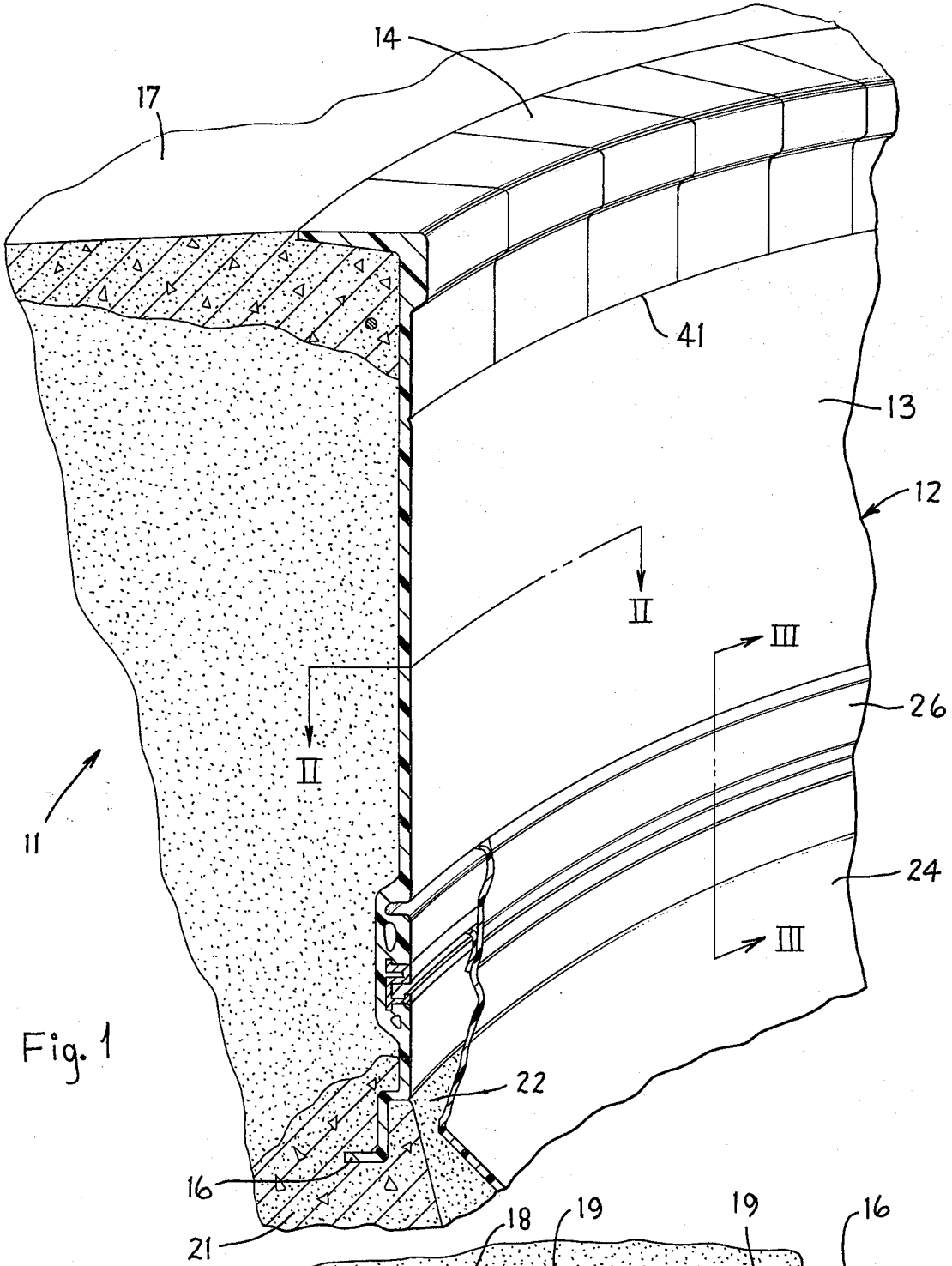
FIG. 1 is a fragmentary perspective view of a swimming pool structure according to the present invention.

Certain terminology will be used in the following description for convenience in reference only and will not be limiting. For example, the words "upwardly", "downwardly", "rightwardly" and "leftwardly" will refer to directions in the drawings to which reference is made. The words "front" and "rear" will also refer to the inner and outer sides, respectively, of the swimming pool walls. The words "inward" and "outward" will refer to directions toward and away from, respectively, the geometric center of the structure and designated parts thereof. Said terminology will include the words above specifically mentioned, derivatives thereof and words of similar import.

SUMMARY OF THE INVENTION

The objects and purposes of the present invention, including those mentioned above, have been met by providing a swimming pool structure having a sidewall which is preferably constructed from a plurality of prefabricated wall panels. The floor of the pool is formed by utilizing soil, such as sand, and a large flexible sheetlike liner overlies the floor and has the edges thereof mechanically and sealingly connected to the sidewall. The edge of the liner has an enlarged bead mechanically held within a channellike retaining member which is fixed to the sidewall adjacent the lower end thereof. The edge of the liner also has a sheetlike flap which projects upwardly beyond the bead, and has the free edge thereof disposed within a narrow groove which projects horizontally of the sidewall directly above the retaining member. The free edge of the flap is sealingly connected to the pool sidewall, whereby the liner is disposed entirely below the water level.

DETAILED DESCRIPTION

Figure 2:
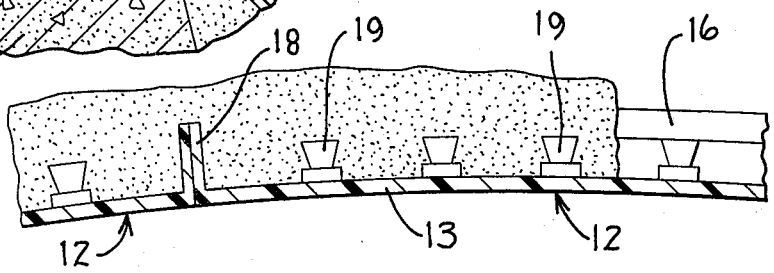
FIG. 2 is a fragmentary sectional view taken along the line II—II in FIG. 1.
Figure 3:
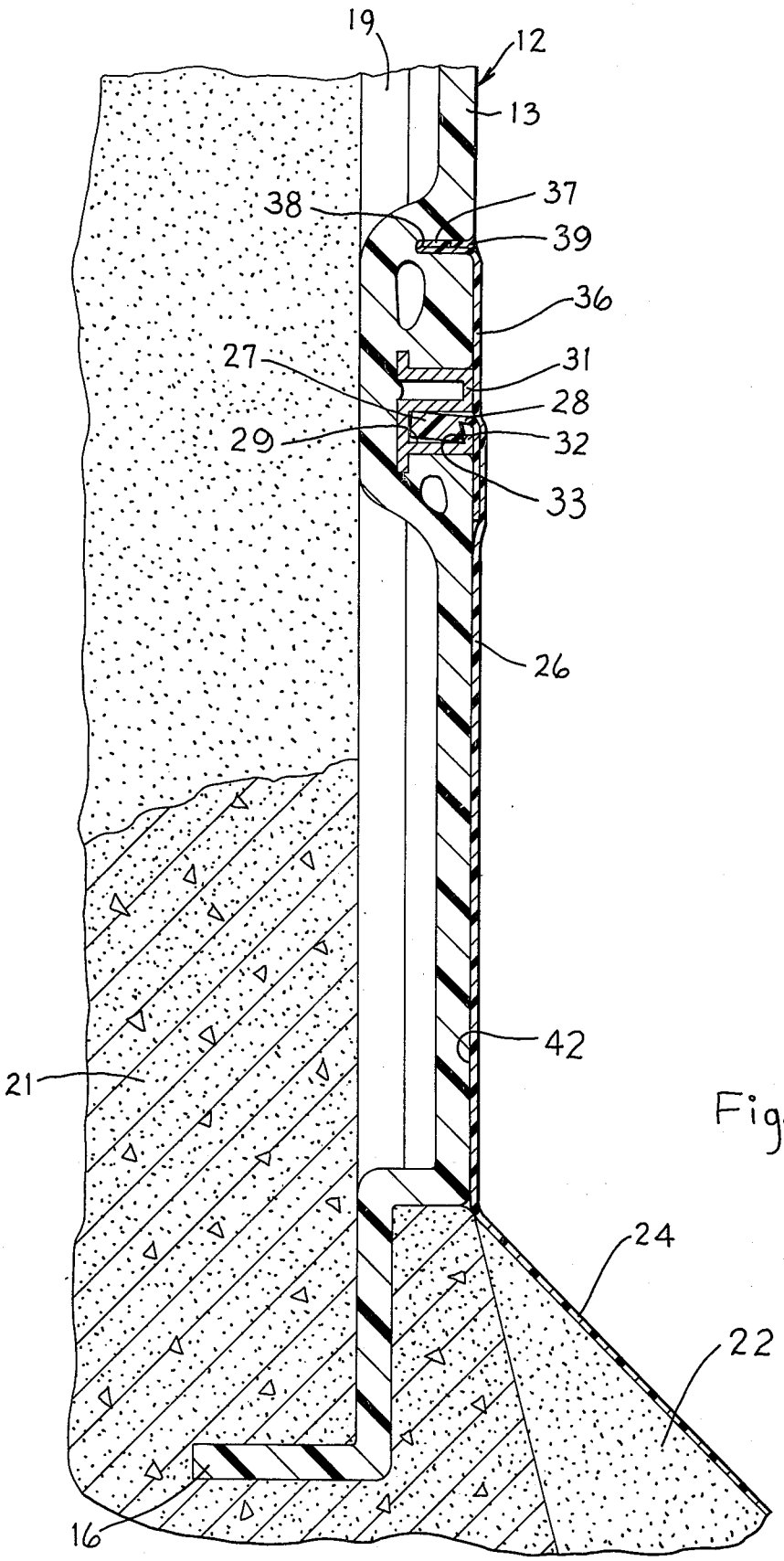
FIG. 3 is an enlarged, fragmentary sectional view taken substantially along the line III—III in FIG. 1.

FIGS. 1–3 illustrate therein a pool construction 11 which utilizes wall panels or sections 12 for forming the pool sidewall. The wall section 12 is preferably prefabricated, such as by being molded from a plastic material having glass fibers embedded therein. Wall panel 12 includes a relatively smooth and enlarged sidewall 13, the upper and lower ends of which are integrally connected to horizontally and rearwardly projecting upper and lower flanges 14 and 16, respectively. The upper flange 14 is disposed substantially flush with the upper surface of a concrete deck 17 which is poured externally of and adjacent the pool sidewall.

The wall panels 12 are also provided with suitable end walls 18 (FIG. 2) which, when two panels are disposed adjacent one another, lie substantially flush with one another to permit the adjacent panels to be suitably fixedly connected, as by means of bolts or the like. The individual wall panels 12 are suitably strengthened by means of reinforcing ribs 19 which extend vertically of the panels and interconnect the upper and lower flanges thereof. The ribs 19, in the illustrated embodiment, are of trapezoidal shape and have the small side thereof fixed to the outer surface of the sidewall 13. The lower ends of the sidewall 13 and the ribs 19 are suitably embedded within a concrete footing 21, which footing may be continuous with the concrete deck 17, and due to the inverted trapezoidal shape of the ribs 19, the ribs become interlocked within the concrete footing 21.

The floor 22 of the pool may be formed from soil, such as sand, which is suitably shaped to provide the desired contour. The floor 22 is then suitably covered by means of a large, flexible, sheetlike liner 24. The liner 24 is conventionally constructed of an impermeable plastic material and has the edge thereof connected to the sidewall of the pool.

According to the present invention, the free edge of the liner 24 is mechanically and sealingly connected to the sidewall 13 at a location which is spaced upwardly from, but disposed closely adjacent, the floor 22. For this purpose, the edge portion 26 of the liner has a blocklike bead 27 formed thereon. In the illustrated embodiment, the bead 27 is formed integrally with a sheetlike flap 28 which is securely mounted to the edge portion 26 of the liner. The bead 27 is received within a sidewardly open slot 29 formed by a substantially Z-shaped locking or retaining member 31. The retaining member 31, which is normally an aluminum extrusion, is fixed to the sidewall 13, as by being embedded therein during the molding of the panel 12, so that the retaining member 31 is substantially flush with the inner surface of the sidewall 13 and extends substantially horizontally along the full width thereof. The retaining member 31 has a small rib 32 which projects upwardly adjacent the front of the slot 29, which rib engages the corner 33 of the bead 27 for locking the bead within the retainer when a tension force is imposed on the liner, such as due to said liner being filled with water.

The bead 27 is normally constructed of a relatively hard and stiff plastics material so as to be capable of being maintained within the slot 29 when a tension force is imposed on the liner. The bead 27 preferably has a thickness which is slightly less than the width of the slot as disposed above the rib 32 so as to enable the bead to freely pass into the slot, whereupon imposition of a tension force on the liner causes a slight tilting of the bead so that same becomes wedged between the top wall of the slot and the rib 32, as illustrated in FIG. 3.

The liner 24 also has a sheetlike flap or extension 36 formed on the edge thereof, which flap 36 extends upwardly beyond the bead 27. The free edge 37 of flap 36 is inserted into a narrow groove 38 which is formed in the sidewall 13. The groove 38 is disposed closely adjacent but slightly above the retaining member 31 and extends substantially parallel with the slot 29. The groove 38, like the slot 29, extends substantially horizontally of the wall panel 12 across the complete width thereof. The free edge 37 of flap 36 is suitably retained in the groove 38 by means of a sealant 38, which sealant extends along the complete periphery of the liner so as to create a watertight sealed relationship between the liner 24 and the sidewall 13 of the pool.

As illustrated in FIGS. 1 and 3, the slot 29 and groove 38 are formed adjacent the lower end of the sidewall 13, and are positioned so that they are spaced upwardly only a small distance from the floor 22. For example, in a preferred embodiment, the slot 29 is spaced upwardly from the floor 22 by a distance of about 8 inches, but the slot 29 could be disposed within the range of between approximately 2 and 12 inches from the floor if desired. The slot 38 is also disposed adjacent the lower end of the sidewall 13 and is preferably positioned between about 1 and 3 inches above the slot 29. In this manner, the liner thus projects upwardly along the sidewall 13 for only a very limited extent, whereby a great majority of the area of the sidewall 13 is not covered by the liner. Since the water level in the pool is normally at a level which is roughly represented by the line 41 in FIG. 1, the liner 24 is thus totally immersed within the water of the pool and the sidewall areas of the pool which are subjected to the heaviest abuse are not covered by the liner, thereby substantially reducing liner damage.

While FIG. 3 illustrates the flap 36 as integral with the main body of the liner 24, and the bead 27 and its flap 28 as being adhesively bonded to the liner, it will be readily apparent that numerous other structures could be provided so as to structurally and functionally coact in the same manner. For example, bead 27 and its flap 28 could be made continuous with the main liner 24, whereupon flap 36 would then be adhesively secured to the main liner. As a further alternative, flaps 28 and 36 could both be adhesively secured to the free edge of the main liner 24.

The sealed connection between the liner 24 and the sidewall 13 can be further enhanced by causing the opposed faces of the liner and the sidewall to be adhesively secured together. For example, the exposed surface of the sidewall 13, as disposed between the slot 29 and the groove 38, can be provided with sealant thereon so as to sealingly engage the adjacent surface of the flap 36 over substantially the complete vertical height thereof. Similarly, the inner surface of the sidewall 13 below the slot 29 can also have a sealant applied thereto so as to sealingly engage the adjacent face of the liner, such as the face 42 as illustrated in FIG. 3.

The sealant 39 preferably comprises a conventional butyl rubber caulking which remains soft and pliable but provides a watertight seal between the liner and the wall. However, numerous other sealants and adhesives can be used for sealing, and possibly adhesively bonding, the liner to the wall. However, use of a sealant which remains soft is preferable since otherwise replacement of the liner is extremely difficult.

Although a particular preferred embodiment of the present invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a swimming pool structure having rigid sidewall means and a flexible sheetlike liner defining the floor of the pool structure, the liner having the edge thereof connected to the sidewall means, the improvement comprising:

connecting means coacting between the peripheral edge portion of said liner and said sidewall means for mechanically and sealingly connecting said peripheral edge portion of said liner to said sidewall means at a location disposed so that a majority of the surface area of the sidewall means is not covered by said liner;

said connecting means including first means mechanically connecting said liner to said sidewall means at a location disposed adjacent the lower end of said sidewall means and second means for sealing said liner to said sidewall means at a location disposed closely adjacent but spaced slightly upwardly from said first means;

said first means including a first elongated groove formed in said sidewall means adjacent the lower end thereof, said first groove being spaced upwardly a small distance above the intersection between the floor and the sidewall means, and said liner having an enlarged bead formed thereon adjacent the free edge thereof, said enlarged bead being lockingly held within said first groove;

said second means including a second elongated groove formed in said sidewall means, said second groove being spaced upwardly a small distance from said first groove, said liner including a flaplike extension projecting upwardly above said first groove and having the free edge thereof positioned within said second groove, said second means also including sealant means positioned within said second groove and sealingly connecting said liner to said sidewall means; and said sidewall means includes a plurality of separate wall panels formed from a plastic material and each having a wall portion adjacent the lower end thereof near the intersection of said sidewall means and said floor that is thicker than the remainder of said sidewall means, said wall portion having said second groove formed therein, and an aluminum member embedded within said wall portion below said second groove, said aluminum member having two oppositely opening channels with one of said channels opening outwardly of said sidewall means and defining said first groove.

* * * * *